US011680393B2

(12) United States Patent
Gross

(10) Patent No.: US 11,680,393 B2
(45) Date of Patent: Jun. 20, 2023

(54) STANDPIPE FREEZE PROTECTION DEVICE

(71) Applicant: Water Kase LLC, White Salmon, WA (US)

(72) Inventor: William L. Gross, White Salmon, WA (US)

(73) Assignee: WATER KASE LLC, White Salmon, WA (US)

( * ) Notice: Subject to any disclaimer, the term of this patent is extended or adjusted under 35 U.S.C. 154(b) by 0 days.

(21) Appl. No.: 17/692,044

(22) Filed: Mar. 10, 2022

(65) Prior Publication Data

US 2022/0307241 A1 Sep. 29, 2022

Related U.S. Application Data

(60) Provisional application No. 63/166,487, filed on Mar. 26, 2021.

(51) Int. Cl.
*E03B 7/12* (2006.01)

(52) U.S. Cl.
CPC ..... *E03B 7/12* (2013.01)

(58) Field of Classification Search
CPC ..... E03B 7/12
See application file for complete search history.

(56) References Cited

U.S. PATENT DOCUMENTS 2,062,246 A * 11/1936 Atkinson ..... F16L 53/32 137/340
2,932,313 A * 4/1960 Noland ..... E03B 7/12 165/142

FOREIGN PATENT DOCUMENTS

CN 110295626 A * 10/2019 ..... E02D 29/10
CN 113513632 A * 10/2021
KR 20210031161 A * 3/2021

OTHER PUBLICATIONS

Woon Mar. 2021 translation of KR20210031161 (Year: 2021).*
Zhang Oct. 2021 translation of cn113513632 (Year: 2021).*
GE Oct. 2019 translation of cn 110295626 (Year: 2019).*

* cited by examiner

*Primary Examiner* — Kevin R Barss
(74) *Attorney, Agent, or Firm* — Miller Nash LLP

(57) ABSTRACT

A standpipe freeze-protection device having a frustum shell. The shell has a first end, a second end, an outer surface, and a plurality of drain apertures. The first end has a first surface that substantially closes the first end except for an opening within the first surface. The opening is configured to allow a standpipe to pass through the opening. The second end is opposite the first end and is substantially open. The outer surface extends between the first end and the second end. The plurality of drain apertures are through the outer surface of the shell.

20 Claims, 8 Drawing Sheets

STANDPIPE FREEZE PROTECTION DEVICE

CROSS-REFERENCES TO RELATED APPLICATIONS

This patent application claims the benefit of provisional Application No. 63/166,487 filed Mar. 26, 2021, which is incorporated into the present disclosure by this reference.

TECHNICAL FIELD

The subject matter is related to a system and methods for preventing damage from freezing for ground-mounted standpipes.

BACKGROUND

As used in this disclosure, as standpipe is a pipe carrying water or another liquid that extends from the ground. Such standpipes may be used, for example, to attach a garden hose. Existing designs are prone to freezing damage or require filling the area around the standpipe with rocks or stones. Configurations of the disclosed technology address shortcomings in the prior art.

DETAILED DESCRIPTION

As described herein, aspects are directed to a standpipe freeze-protection device. In configurations, the standpipe freeze-protection device includes a shell configured to allow a standpipe to pass through a portion of the shell. The shell provides a chamber to prevent water or other liquids (whether from leaking or dripping from the standpipe, condensing on the outside of the standpipe, or otherwise) from collecting within the chamber. Apertures within the shell permit the water or other liquid to drain from the chamber to a region outside of the standpipe freeze-protection device, such as into the surrounding ground in which the standpipe is mounted. The chamber also provides expansion space for water or other liquid that does not drain but instead accumulates within the chamber and freezes, thus reducing or eliminating pressure on the standpipe from the expanding liquid. Unlike conventional apparatuses, the described standpipe freeze-protection device does not require backfilling with rocks or the like, thereby allowing for faster and more efficient installation.

Figure 1:
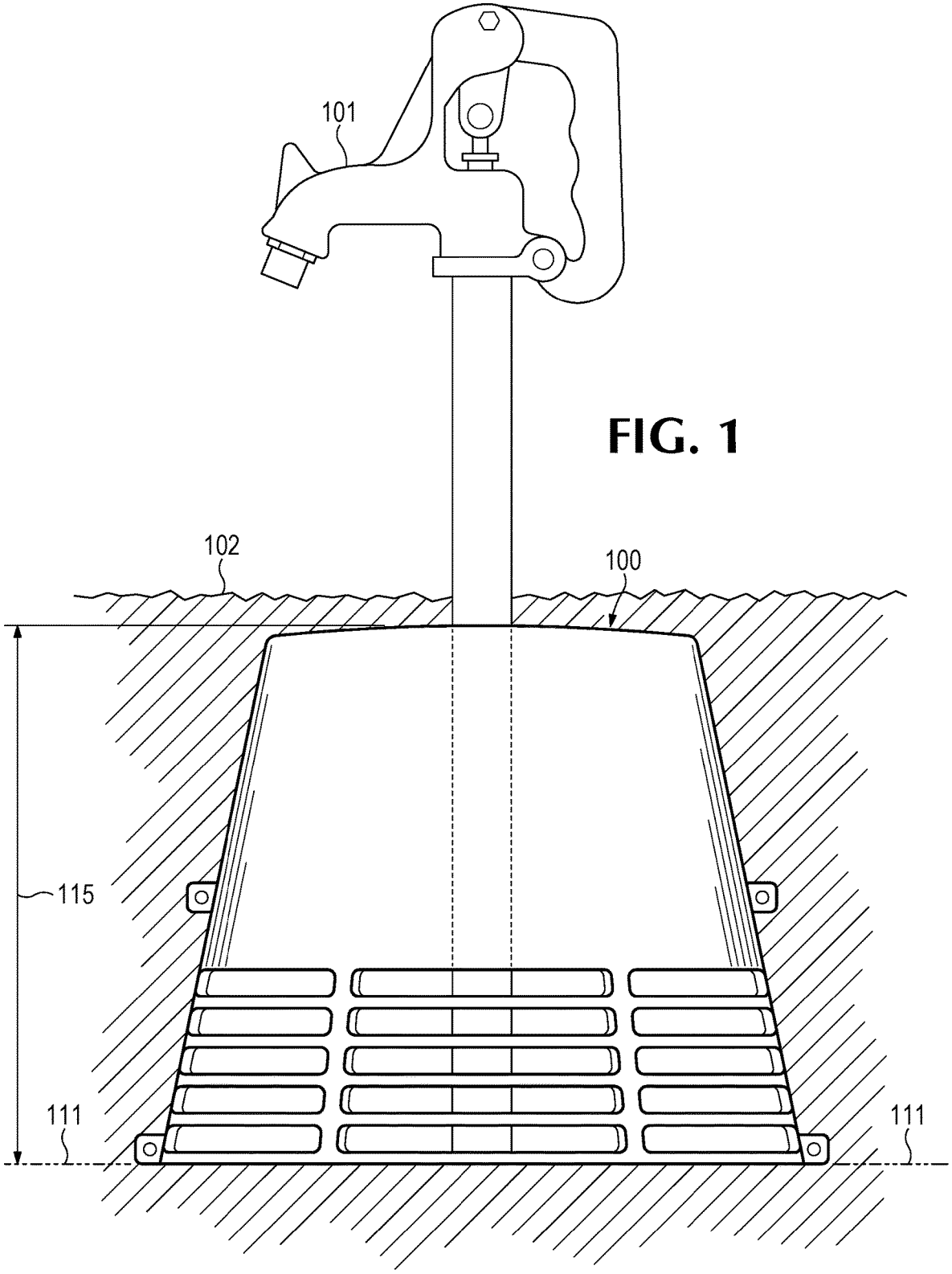
FIG. 1 illustrates a standpipe freeze-protection device, according to an example configuration, installed on a standpipe and buried under soil.
Figure 2:
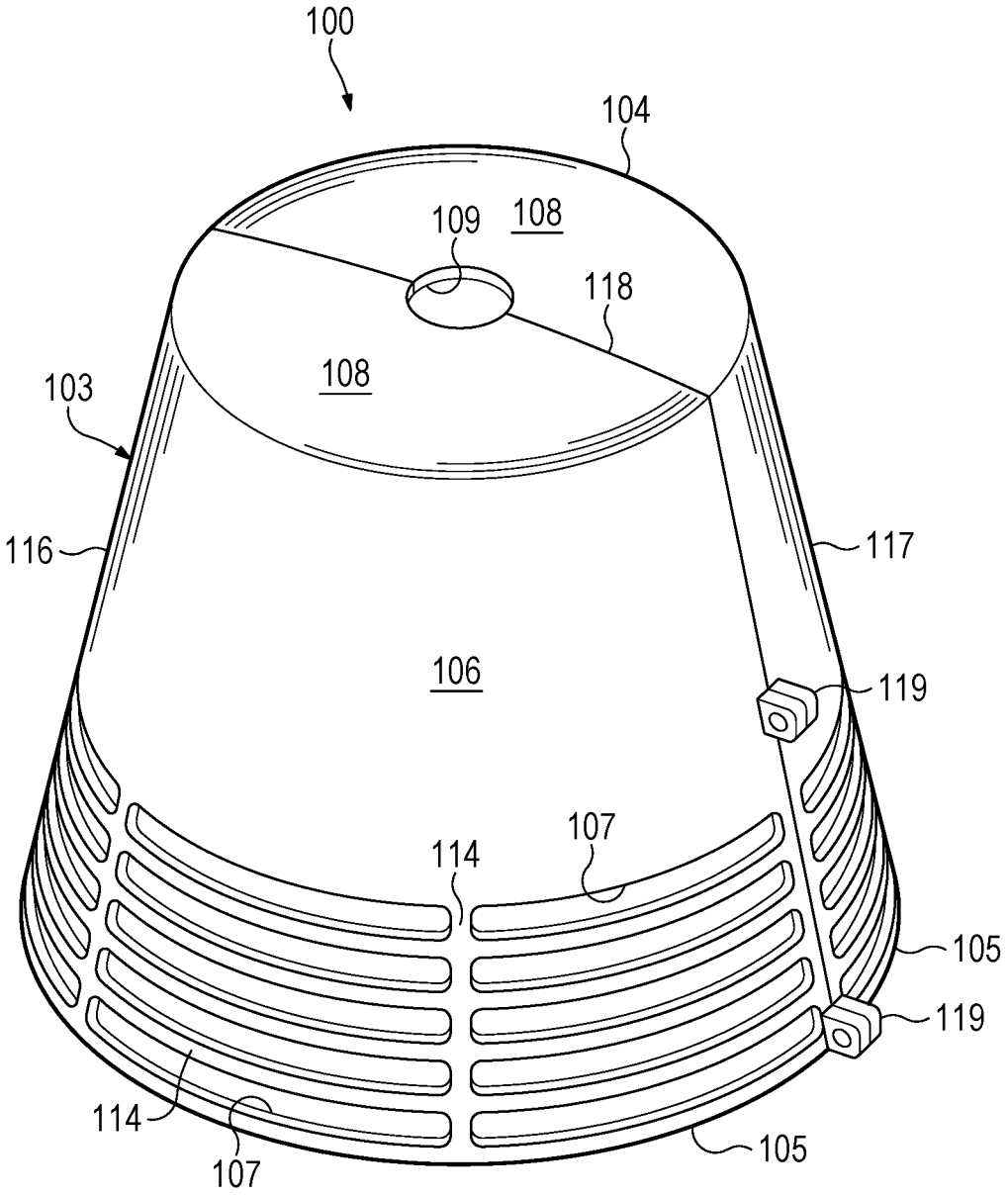
FIG. 2 is a top perspective view of the standpipe freeze-protection device of FIG. 1 in isolation.
Figure 3:
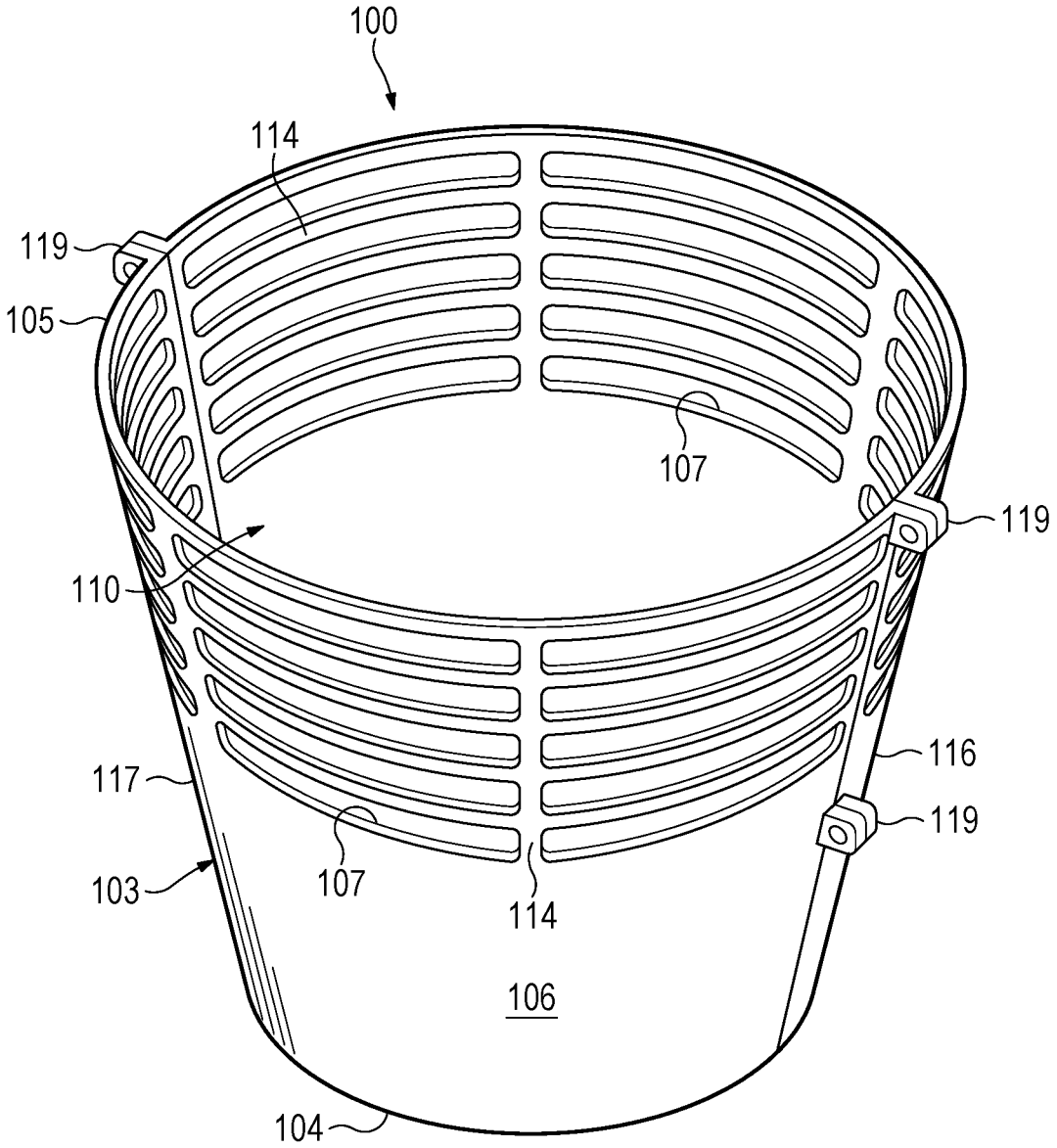
FIG. 3 is a bottom perspective view of the standpipe freeze-protection device of FIG. 2.
Figure 4:
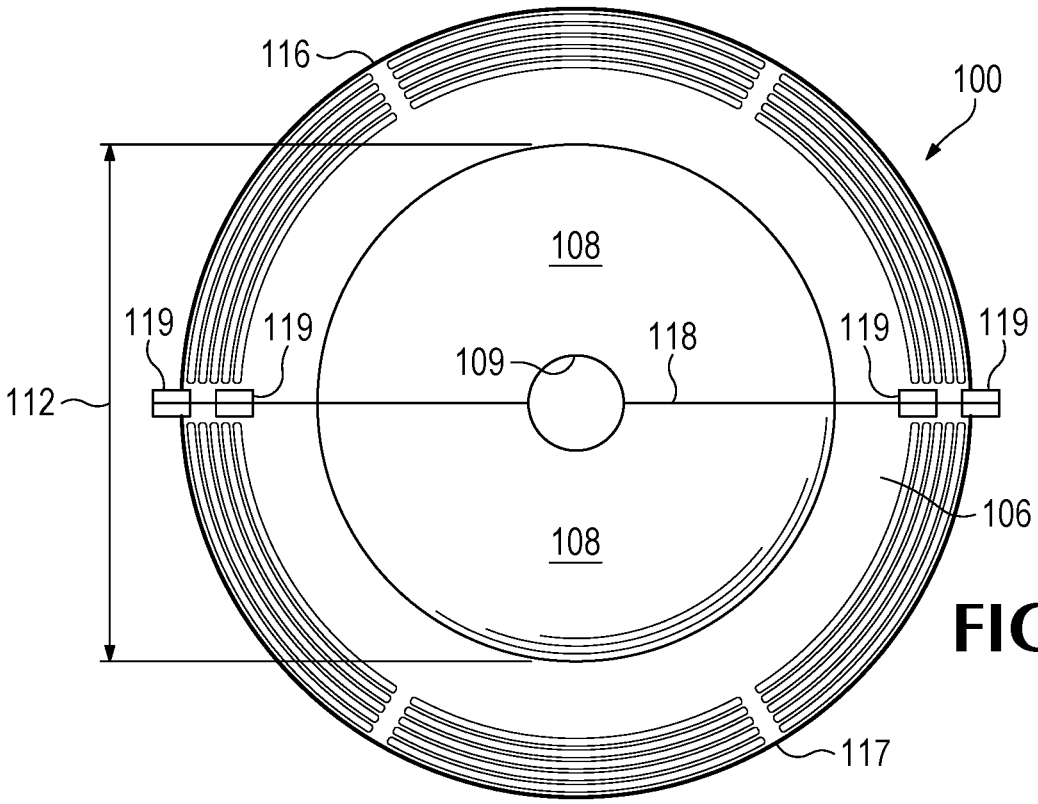
FIG. 4 is a top view of the standpipe freeze-protection device of FIG. 2.
Figure 5:
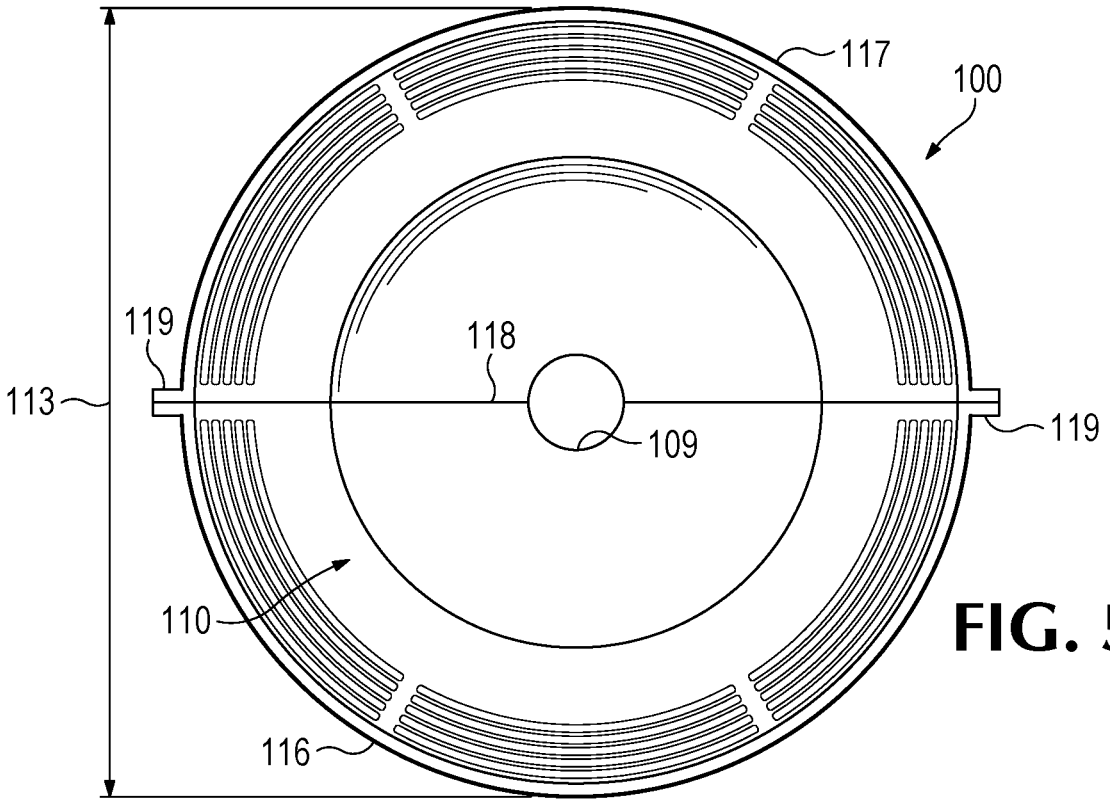
FIG. 5 is a bottom view of the standpipe freeze-protection device of FIG. 2.
Figure 6:
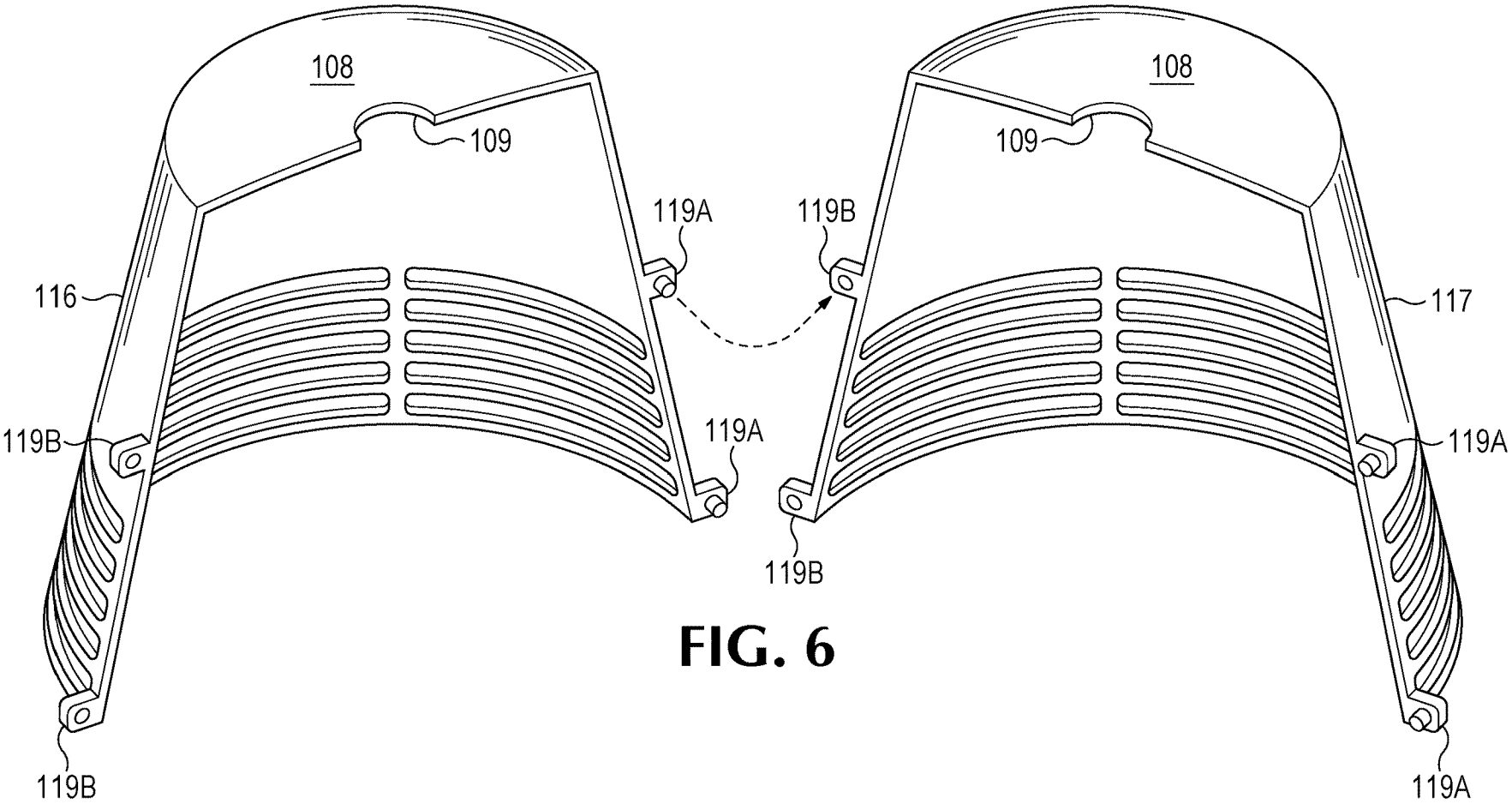
FIG. 6 is a perspective view of the standpipe freeze-protection device of FIG. 2, showing example of separable portions of the standpipe freeze-protection device.

FIG. 1 illustrates portions of a standpipe freeze-protection device 100, according to an example configuration. The standpipe freeze-protection device 100 is shown in an example installation, installed on a standpipe 101 and buried under soil 102. FIG. 2 is a top perspective view of the standpipe freeze-protection device 100 of FIG. 1 in isolation. FIG. 3 is a bottom perspective view of the standpipe freeze-protection device 100 of FIG. 2. FIG. 4 is a top view of the standpipe freeze-protection device 100 of FIG. 2. FIG. 5 is a bottom view of the standpipe freeze-protection device 100 of FIG. 2. FIG. 6 is a perspective view of the standpipe freeze-protection device 100 of FIG. 2, showing example of separable portions 116, 117 of the standpipe freeze-protection device 100. The standpipe 101 may be, for example, a type of standpipe known as a frost-free hydrant or a frost-proof hydrant.

As illustrated in FIGS. 1-6, a standpipe freeze-protection device 100 may include a frustum shell 103. In configurations, the shell 103 may be substantially frustoconical. As used in this context, "substantially frustoconical" means largely or essentially the shape of a frustum of a cone. In configurations, the shell 103 may be a right, circular, conic frustum, such as illustrated in FIGS. 1-6. In configurations, instead of the conical frustum illustrated in FIGS. 1-6, the shell 103 may have polygonal faces, such as squares, rectangles, and trapezoids.

As illustrated, the shell 103 includes a first end 104, a second end 105, an outer surface 106, and drain apertures 107.

The first end 104 has a first surface 108. The first surface 108 substantially closes the first end 104, except for an opening, or cutout, 109 within the first surface 108. As used in this context, "substantially closes" means largely or essentially obstructs, without requiring a perfect barricade to all access. In configurations, the first surface 108 may be circular, square, rectangular, or pentagonal, as examples, or have another polygonal shape. The opening 109 is configured to accommodate a standpipe 101 through the opening 109, for example, as shown in FIG. 1.

The second end 105 is opposite the first end 104 and is substantially open. As used in this context, "substantially open" means largely or essentially allowing unobstructed access to the chamber 110 within the shell 103. In configurations, a reference plane 111 extending across the second end 105 is substantially parallel to the first surface 108. As used in this context, "substantially parallel" means largely or essentially equidistant at all points, without requiring perfect parallelism.

In configurations where the first end 104 and the second end 105 are circular, the first end 104 has an outer diameter 112 and the second end 105 has an outer diameter 113. Preferably, the outer diameter 112 of the first end 104 is about 30% to about 100% of the outer diameter 113 of the second end 105. More preferably, the outer diameter 112 of the first end 104 is about 45% to about 85% of the outer diameter 113 of the second end 105. Even more preferably, the outer diameter 112 of the first end 104 is about 60% to about 70% of the outer diameter 113 of the second end 105.

The outer surface 106 extends between the first end 104 and the second end 105. A chamber 110 within the shell 103, bounded by the first surface 108, the outer surface 106, and the reference plane 111, is substantially hollow. As used in this context, "substantially hollow" means largely or essentially empty, without requiring perfect vacancy.

The plurality of drain apertures 107 are through the outer surface 106 of the shell 103. The drain apertures 107 are configured to permit water and other fluids to drain from the chamber 110 to a region outside of the standpipe freeze-protection device 100 (such as into the soil 102). In configurations, each of the drain apertures 107 is substantially rectangular and separated by ribs 114. As used in this context, "substantially rectangular" means largely or essentially shaped like a rectangle or a square. The standpipe freeze-protection device 100 has a height 115 measured from the second end 105 to the first end 104 along the outer surface 106 of the shell 103. In configurations, the drain apertures 107 are only within a first half of the height 115 (measured from the second end 105 toward the first end 104). Among other advantages, having the drain apertures 107 only within a first half of the height 115 helps to prevent or reduce the amount of silt that may enter the chamber 110 during normal use of the standpipe freeze-protection device 100.

As illustrated in FIGS. 1-6, in configurations the shell 103 comprises at least two pieces, such as a first portion 116 and a second portion 117. The pieces 116, 117 are separable along a dividing line 118 that passes through the opening 109 in the first surface 108. In configurations, the shell 103 has two substantially identical halves 116, 117 that are separable along the dividing line 118. As used in this context, "substantially identical" means largely or essentially the same, without requiring perfect similarity in every way. An example of substantially identical halves 116, 117 is illustrated in FIG. 6. In configurations, the separable pieces 116, 117 (whether identical halves or otherwise) are coupled together by a fastener 119. In configurations, the separable pieces may be coupled together by more than one fastener 119. In configurations, the fastener 119 includes a first portion 119A of the fastener 119 in an interference fit with a second portion 1198 of the fastener 119. The fastener 119 may be, for example, opposed (male and female) snap fittings that mechanically engage to retain the separable pieces together.

Figure 7:
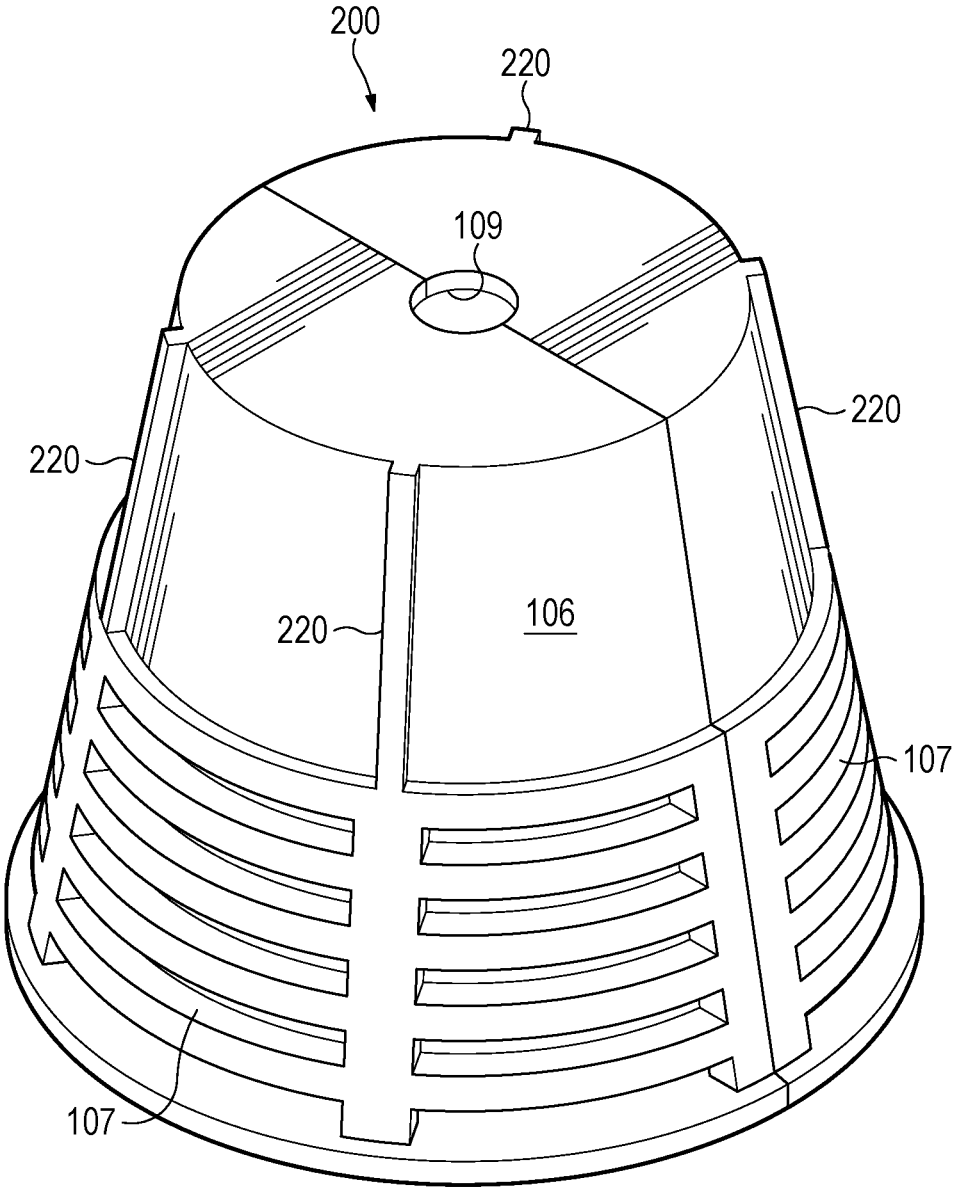
FIG. 7 is a top perspective view of a standpipe freeze-protection device, according to a second example configuration.
Figure 8:
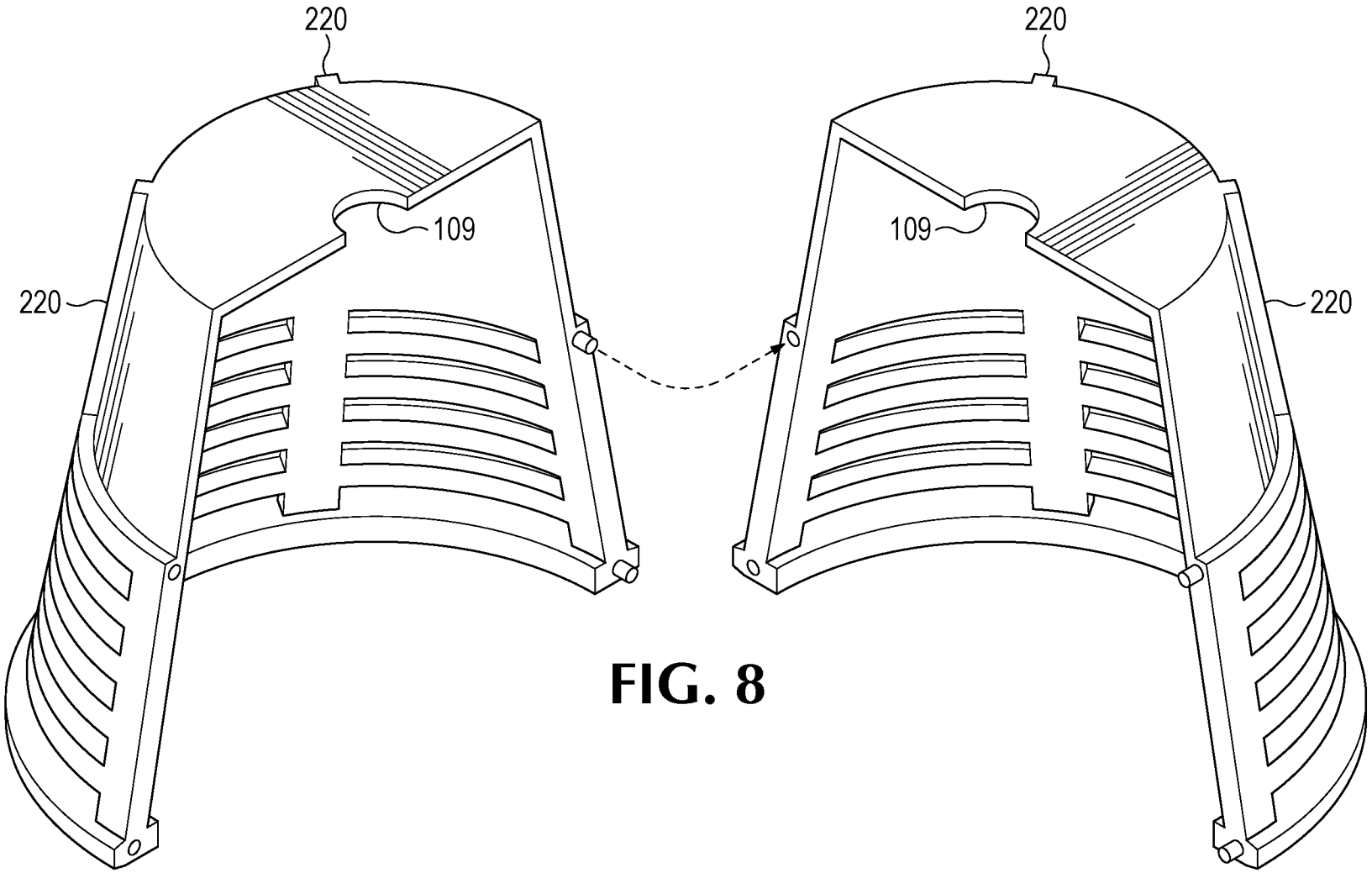
FIG. 8 is a perspective view of the standpipe freeze-protection device of FIG. 7, showing example of separable portions of the standpipe freeze-protection device.

FIG. 7 is a top perspective view of a standpipe freeze-protection device, according to a second example configuration. FIG. 8 is a perspective view of the standpipe freeze-protection device of FIG. 7, showing example of separable portions of the standpipe freeze-protection device. The configuration FIGS. 7-8 may have the features described for FIGS. 1-6; hence the same reference numbers are used. As illustrated in FIGS. 7-8, the standpipe freeze-protection device 200 may include stiffening flanges 220 that extend longitudinally along the outer surface 106 to enhance the stiffness of the outer surface 106. In configurations where the drain apertures 107 are only within the first half of the height 115, the stiffening flanges 220 may be only within the second half of the height 115. As illustrated in FIG. 8, in configurations the portion of the outer surface 106 having the drain apertures 107 may be thicker than the portion of the outer surface 106 without the drain apertures 107 to provide additional strength to that part of the standpipe freeze-protection device 100. While illustrated for the configurations shown FIGS. 7-8, the stiffening flanges 220 or the thicker portion of the outer surface 106, or both, may be included in any of the configurators illustrated in FIGS. 1-6.

The standpipe freeze-protection device 100 of any of FIGS. 1-8 made be made from metal, plastic, or other suitably rigid material capable of maintaining the shape of the standpipe freeze-protection device 100 in normal use as described here.

Figure 9:
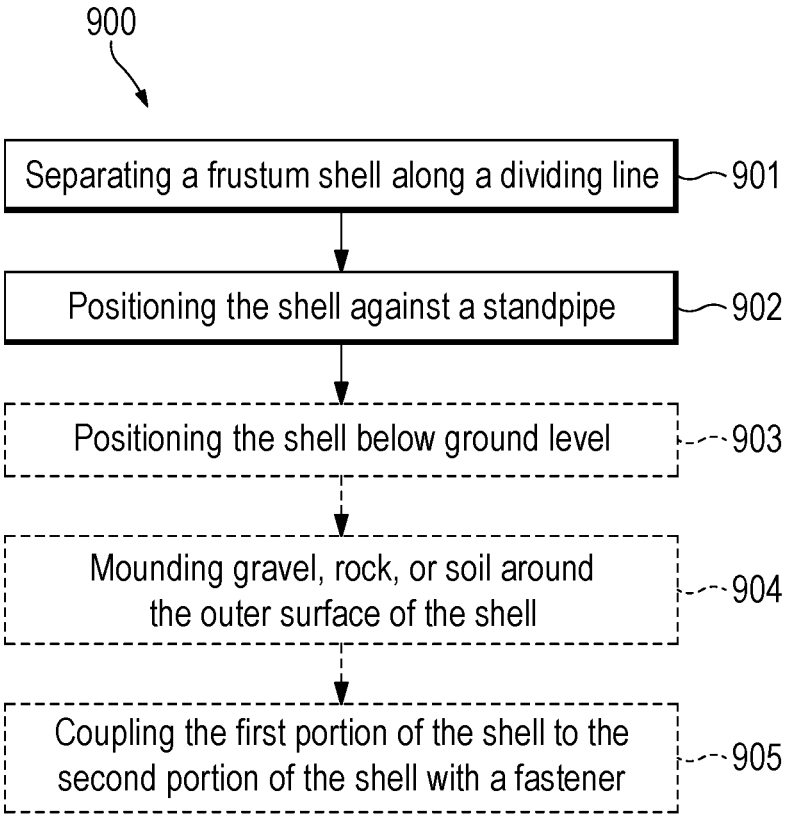
FIG. 9 illustrates an example method of using a standpipe freeze-protection device, according to an example configuration.

FIG. 9 illustrates an example method 900 of using a standpipe freeze-protection device 100, according to an example configuration. As illustrated, the example method 900 may include separating 901 a frustum shell 103 along a dividing line 118 to create a first portion 116 of the shell 103 and a second portion 117 of the shell 103 and positioning 902 the first portion 116 of the shell 103 and the second portion 117 of the shell 103 against a standpipe 101, such that the standpipe 101 passes through the opening 109.

In configurations, the example method 900 may further include positioning 903 the shell 103 below ground level; and mounding 904 gravel, rock, or soil 102 around the outer surface 106 of the shell 103. In configurations, the mounding 904 gravel, rock, or soil is without backfilling the chamber 110 within the shell 103. In this context, "backfilling" means to fill the chamber 110 with soil, gravel, rocks, or the like.

In configurations, the example method may further include, after positioning 902 the first portion 116 of the shell 103 and the second portion 117 of the shell 103 against a standpipe 101, coupling 905 the first portion 116 of the shell 103 to the second portion 117 of the shell 103 with a fastener 119.

EXAMPLES

Illustrative examples of the disclosed technologies are provided below. A particular configuration of the technologies may include one or more, and any combination of, the examples described below.

Example 1 includes a standpipe freeze-protection device comprising a substantially frustoconical shell, the shell having: a first end having a first surface, the first surface substantially closing the first end except for a cutout within the first surface, the cutout configured to accommodate a standpipe through the cutout; a second end opposite the first end, the second end being substantially open; an outer surface extending between the first end and the second end; and a plurality of drain apertures through the outer surface of the shell.

Example 2 includes the device of Example 1, in which the shell comprises at least two pieces, the at least two pieces being separable along a dividing line through the cutout.

Example 3 includes the device of Example 2, in which each of the at least two pieces are coupled together by a fastener.

Example 4 includes the device of Example 3, in which the fastener comprises a first piece of the fastener in an interference fit with a second piece of the fastener.

Example 5 includes the device of any of Examples 1-4, in which the shell comprises two substantially identical halves, the two halves being separable along a dividing line through the cutout.

Example 6 includes the device of Example 5, in which the halves are coupled together by a first fastener.

Example 7 includes the device of Example 6, in which the first fastener comprises a snap fitting.

Example 8 includes the device of any of Examples 6-7, in which the halves are further coupled together by a second fastener.

Example 9 includes the device of any of Examples 1-8, in which the first end has an outer diameter and the second end has an outer diameter, the outer diameter of the first end being about 60% to about 70% of the outer diameter of the second end.

Example 10 includes the device of any of Examples 1-9, further having a height measured from the second end to the first end along the outer surface of the shell, in which the plurality of drain apertures are only within a first half of the height measured from the second end toward the first end.

Example 11 includes the device of Example 10, the outer surface have a first thickness within the first half of the height and a second thickness within a second half of the height, the first thickness being greater than the second thickness.

Example 12 includes the device of any of Examples 1-11, each of the plurality drain apertures being substantially rectangular and separated by ribs.

Example 13 includes the device of any of Examples 1-12, further comprising stiffening flanges extending from the first end toward the second end.

Example 14 includes a standpipe freeze-protection device comprising a frustum shell, the shell having: a first end having a first surface, the first surface substantially closing the first end except for an opening within the first surface, the opening configured to allow a standpipe to pass through the opening; a second end opposite the first end, the second end being substantially open; an outer surface extending between the first end and the second end; and a plurality of drain apertures through the outer surface of the shell.

Example 15 includes the device of Example 14, in which the shell comprises at least two pieces, the at least two pieces being separable along a dividing line passing through the opening.

Example 16 includes the device of Example 15, in which the at least two pieces are coupled together by a fastener.

Example 17 includes the device of Example 16, in which the fastener comprises a first portion of the fastener in an interference fit with a second portion of the fastener.

Example 18 includes the device of any of Examples 14-17, in which the shell comprises two substantially identical halves, the two halves being separable along a dividing line through the opening.

Example 19 includes the device of Example 18, in which the halves are coupled together by a first fastener.

Example 20 includes the device of Example 19, in which the first fastener comprises a snap fitting.

Example 21 includes the device of any of Examples 19-20, in which the halves are further coupled together by a second fastener.

Example 22 includes the device of any of Examples 14-21, further having a height measured from the second end to the first end along the outer surface of the shell, in which the plurality of drain apertures are only within a first half of the height measured from the second end toward the first end.

Example 23 includes the device of Example 22, the outer surface have a first thickness within the first half of the height and a second thickness within a second half of the height, the first thickness being greater than the second thickness.

Example 24 includes the device of any of Examples 14-23, each of the plurality drain apertures being substantially rectangular and separated by ribs.

Example 25 includes the device of any of Examples 14-24, further comprising stiffening flanges extending from the first end toward the second end.

Example 26 includes a method of installing a standpipe freeze-protection device, the method comprising: separating a frustum shell along a dividing line to create a first portion of the shell and a second portion of the shell, the shell comprising a first end having a first surface, the first surface substantially closing the first end except for an opening within the first surface, the dividing line passing through the opening, a second end opposite the first end, the second end being substantially open, an outer surface extending between the first end and the second end, and a plurality of drain apertures through the outer surface of the shell; and positioning the first portion of the shell and the second portion of the shell against a standpipe, such that the standpipe passes through the opening.

Example 27 includes the method of Example 26, further comprising: positioning the shell below ground level; and mounding gravel or soil around the outer surface of the shell.

Example 28 includes the method of claim 18, in which the mounding gravel or soil is without backfilling a chamber within the shell and bounded by the first surface, the outer surface, and the second end.

Example 29 includes the method of Example 26, further comprising, after positioning the first portion of the shell and the second portion of the shell against a standpipe, coupling the first portion of the shell to the second portion of the shell with a fastener.

The previously described versions of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular example configuration, that feature can also be used, to the extent possible, in the context of other example configurations.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Also, directions such as "vertical," "horizontal," "right," and "left" may be used for convenience and in reference to the views provided in figures. But the standpipe freeze-protection device may have a number of orientations in actual use. Thus, a feature that is vertical, horizontal, to the right, or to the left in the figures may not have that same orientation or direction in actual use.

Although specific example configurations have been described for purposes of illustration, it will be understood that various modifications may be made without departing from the spirit and scope of the disclosure.

I claim:

1. A standpipe freeze-protection device comprising a substantially frustoconical shell, the shell having:

a first end having a first surface, the first surface substantially closing the first end except for a cutout within the first surface, the cutout configured to accommodate a standpipe through the cutout;

a second end opposite the first end, the second end being substantially open;

an outer surface extending between the first end and the second end; and a plurality of drain apertures through the outer surface of the shell.

2. The device of claim 1, in which the shell comprises at least two pieces, the at least two pieces being separable along a dividing line through the cutout.

3. The device of claim 2, in which each of the at least two pieces are coupled together by a fastener, in which the fastener comprises a first piece of the fastener in an interference fit with a second piece of the fastener.

4. The device of claim 1, in which the shell comprises two substantially identical halves, the two halves being separable along a dividing line through the cutout.

5. The device of claim 4, in which the halves are coupled together by at least one fastener.

6. The device of claim 1, further having a height measured from the second end to the first end along the outer surface of the shell, in which the plurality of drain apertures are only within a first half of the height measured from the second end toward the first end.

7. The device of claim 6, the outer surface have a first thickness within the first half of the height and a second thickness within a second half of the height, the first thickness being greater than the second thickness.

8. The device of claim 1, further comprising stiffening flanges extending from the first end toward the second end.

9. A standpipe freeze-protection device comprising a frustum shell, the shell having:

a first end having a first surface, the first surface substantially closing the first end except for an opening within the first surface, the opening configured to allow a standpipe to pass through the opening;

a second end opposite the first end, the second end being substantially open;

an outer surface extending between the first end and the second end; and a plurality of drain apertures through the outer surface of the shell.

10. The device of claim 9, in which the shell comprises at least two pieces, the at least two pieces being separable along a dividing line passing through the opening.

11. The device of claim 10, in which the at least two pieces are coupled together by a fastener, in which the fastener comprises a first portion of the fastener in an interference fit with a second portion of the fastener.

12. The device of claim 9, in which the shell comprises two substantially identical halves, the two halves being separable along a dividing line through the opening.

13. The device of claim 12, in which the halves are coupled together by at least one fastener.

14. The device of claim 9, further having a height measured from the second end to the first end along the outer surface of the shell, in which the plurality of drain apertures are only within a first half of the height measured from the second end toward the first end.

15. The device of claim 14, the outer surface have a first thickness within the first half of the height and a second thickness within a second half of the height, the first thickness being greater than the second thickness.

16. The device of claim 9, further comprising stiffening flanges extending from the first end toward the second end.

17. A method of installing a standpipe freeze-protection device, the method comprising:

separating a frustum shell along a dividing line to create a first portion of the shell and a second portion of the shell, the shell comprising a first end having a first surface, the first surface substantially closing the first end except for an opening within the first surface, the dividing line passing through the opening, a second end opposite the first end, the second end being substantially open, an outer surface extending between the first end and the second end, and a plurality of drain apertures through the outer surface of the shell; and positioning the first portion of the shell and the second portion of the shell against a standpipe, such that the standpipe passes through the opening.

18. The method of claim 17, further comprising:

positioning the shell below ground level; and mounding gravel, rock, or soil around the outer surface of the shell.

19. The method of claim 18, in which the mounding gravel, rock, or soil is without backfilling a chamber within the shell and bounded by the first surface, the outer surface, and the second end.

20. The method of claim 17, further comprising, after positioning the first portion of the shell and the second portion of the shell against a standpipe, coupling the first portion of the shell to the second portion of the shell with a fastener.

* * * * *